United States Patent [19]

Dittrich

[11] 4,151,989

[45] May 1, 1979

[54] BASKETBALL PRACTICE DEVICE

[75] Inventor: William A. Dittrich, Bellingham, Wash.

[73] Assignee: Dunk King Inc., Bellingham, Wash.

[21] Appl. No.: 832,661

[22] Filed: Sep. 12, 1977

Related U.S. Application Data

[63] Continuation-in-part of Ser. No. 707,325, Jul. 21, 1976, abandoned.

[51] Int. Cl.[2] ..... A63B 63/04

[52] U.S. Cl. ..... 273/1.5 A

[58] Field of Search ..... 273/1.5 R, 1.5 A; 172/264, 265, 266, 708, 711, 705; 248/475 B

[56] References Cited

U.S. PATENT DOCUMENTS

| | | | |
|---|---|---|---|
| Re. 20,898 | 10/1938 | Schaminger | 273/1.5 R |
| 418,503 | 12/1889 | Crane | 172/266 |
| 1,194,006 | 8/1916 | Fry | 172/265 |
| 2,230,813 | 2/1941 | Pressman | 273/1.5 R |
| 2,579,312 | 12/1951 | Garvey | 273/1.5 R |
| 2,742,843 | 4/1956 | Redetzke | 172/264 X |
| 2,786,678 | 3/1957 | Fink | 273/1.5 R |
| 3,012,781 | 12/1961 | Nelson | 273/1.5 A |
| 3,181,849 | 5/1965 | Mitchell | 273/1.5 R X |
| 3,194,555 | 7/1965 | Humphery | 273/1.5 R |
| 3,365,196 | 1/1968 | Miller | 273/1.5 A |
| 3,534,956 | 10/1970 | Myers | 273/1.5 A |
| 3,795,396 | 3/1974 | Kropelnitski | 273/1.5 A X |
| 4,111,420 | 9/1978 | Tyner | 273/1.5 R |

FOREIGN PATENT DOCUMENTS

| | | | |
|---|---|---|---|
| 1479428 | 3/1967 | France | 248/475 B |

*Primary Examiner*—Paul E. Shapiro

*Attorney, Agent, or Firm*—Robert W. Beach; Ward Brown

[57] ABSTRACT

A cantilever boom supports a padded basketball hoop above a specified area of a playing surface in a normally horizontal position. The arm can swing universally to permit substantial vertical and/or sideways deflection of the hoop by the application of corresponding forces thereto, such as during the practice of dunk shots. Resilient members bias the hoop to its normally horizontal position.

12 Claims, 4 Drawing Figures

BASKETBALL PRACTICE DEVICE

This application is a continuation-in-part of U.S. application Ser. No. 707,325, filed July 21, 1976, for Basketball Dunking Device, now abandoned.

BACKGROUND OF THE INVENTION

1. Field of the Invention

The present invention relates to a basketball practice hoop displaceable from a normally horizontal position by the application of force to the hoop.

2. Prior Art

Various types of basketball hoop supporting structures permit vertical adjustment of the height of a basketball hoop above a playing surface. Other hoop-supporting structures are foldable and/or retractable to a compact condition for storage. Still other hoop-supporting structures are portable. Several known structures have a combination of these features. However, each of the known devices is designed to support a basketball hoop substantially stationarily in a predetermined established position. Consequently, in practicing the dunk shot with any of the above devices, there is a high risk of injury to a player or to the hoop-supporting structure from the player striking or hanging onto the fixedly positioned hoop.

Devices for measuring or increasing a basketball player's jumping ability are disclosed in the following United States patents:

McCall, Jr. — U.S. Pat. No. 2,939,705
Nelson — U.S. Pat. No. 3,012,781
Kamish — U.S. Pat. No. 3,258,266
Kropelnitski — U.S. Pat. No. 3,795,396

Measurement or development of a player's jumping ability by the device of any of these patents requires tedious and repetitive jumping by the player. Further, none of these devices uses a basketball hoop.

No basketball hoop-supporting structure is known which is designed to permit resilient downward and/or sideways deflection of a hoop.

SUMMARY OF THE INVENTION

It is an object of the present invention to provide a basketball practice device which will develop various basketball skills including jumping ability, timing and coordination.

It is also an object to provide such a device, the use of which will not be tedious to a practicing basketball player.

In accordance with the above objects, it is an object to provide a device for practicing the dunk shot safely.

The foregoing objects can be accomplished by providing a padded basketball hoop supported by structure permitting substantial vertcal and/or sideways deflection of the hoop. In the preferred embodiment of the invention, the hoop is mounted on the end of a cantilever boom for vertical swinging about a generally horizontal pivot, and for sideways swinging about an upright pivot, both of such pivots being offset from the hoop. Resilient members bias the hoop to a normally horizontal position and the resilient members can be adjusted to alter the biasing forces. A shock absorber damps vertical swinging of the hoop.

DETAILED DESCRIPTION

Figures 1, 2, 3, 4:
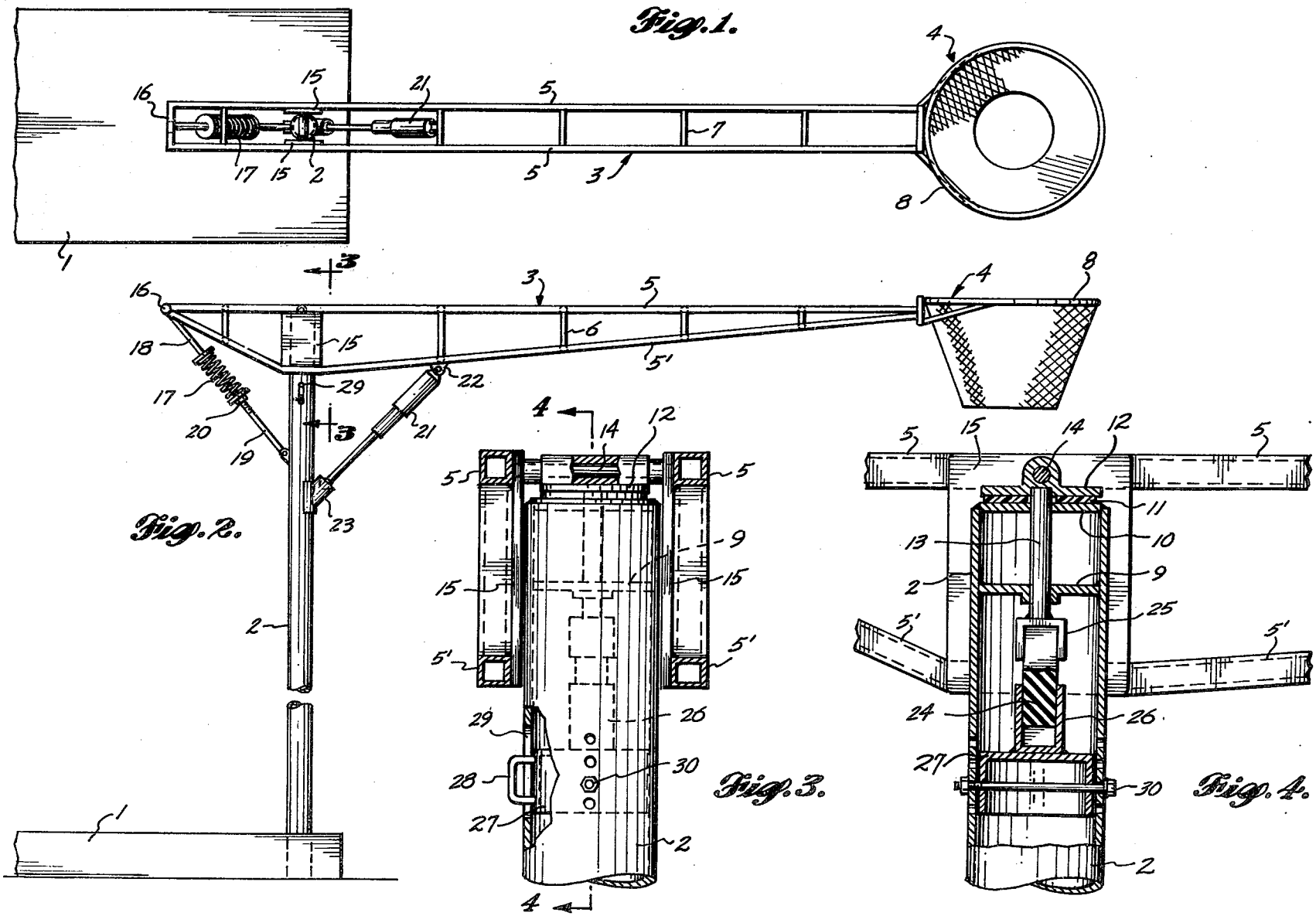
FIG. 1 is a top plan of a basketball practice device in accordance with the present invention.
FIG. 2 is a side elevation of the practice device of FIG. 1 with parts broken away.
FIG. 3 is a section taken on line 3—3 of FIG. 2 with parts broken away.
FIG. 4 is a section taken on line 4—4 of FIG. 3 with parts broken away.

As used herein, the term "dunk shot" means a basketball shot in which a basketball is forced directly through a hoop by a downward thrust motion of a player's hand on the basketball.

There has been increased interest by basketball spectators in the execution of the dunk shot. Naturally, as so-called dunk shot artists receive more recognition by spectators, basketball players become motivated to increase their dunk shot skills. Such motivation is beneficial because the particular skills necessary for braceful execution of the dunk shot, such as jumping ability, timing and coordination, are needed for other facets of the game. However, dunk shot practice with conventional stationary hoops is dangerous both to players and to the hoop-supporting structure because a practicing player often strikes or hangs onto the hoop. In accordance with the present invention, the risk of injury to the supporting structure and the player is reduced by padding the hoop and by including in the supporting structure mechanism allowing substantial downward and/or sideways deflection of the hoop.

In the preferred embodiment of the invention, a base 1 supports a standard 2. In order that the practice device may be used by players of varying jumping abilities, it is preferred that the standard be of adjustable height. The free end of a normally horizontal cantilever boom 3 carries a regulation metal basketball hoop 4. Such boom is mounted on the standard by a universal joint system permitting deflection of the hoop by swinging of the boom. To conserve weight, the boom is formed of tubular upper and lower longitudinal members 5 and 5', respectively, connected by tubular vertical and horizontal cross members 6 and 7, respectively. For safety, elastomer padding 8, such as vinyl or polyurethane foam or sponge rubber, covers the metal hoop.

As best seen in FIG. 4, at least the upper end portion of standard 2 is hollow. A stationary horizontal guide plate 9 is secured inside the upper end portion of the standard below a disk 10 capping the standard upper end. An antifriction member, such as a Teflon pad 11 or a suitable bearing, is interposed between the upper side of the disc cap and the underside of a turntable 12 having an upright pivot shaft 13 journaled in aligned apertures in the antifriction member, disc cap and guide plate. The shaft is coaxial with the upper end portion of the standard. The central portion of a horizontal pivot shaft 14 is journaled in a bearing carried by the turntable and has its opposite ends secured, respectively, to upright parallel plates 15 which connect the upper and lower longitudinal support members 5 and 5' at opposite sides of the standard. As shown in FIG. 3, plates 15 are located close alongside opposite sides of the standard upper portion so that slight swivelling of the boom will engage a plate with the standard to prevent excess strain from being transmitted to the upright pivot shaft by forces tending to tilt the turntable. However, the plates are spaced apart slightly farther than the width of the standard so as not to hinder vertical swinging of hoop 4 about the axis of horizontal shaft 14, or sideways swinging of the hoop about the axis of upright shaft 13.

As best seen in FIG. 2, the supported end of the hoop-supporting boom 3 extends past the axis of horizontal shaft 14 oppositely from hoop 4. A resilient member is connected between the standard and the overhanging end 16 of such oppositely extending boom portion for biasing the hoop to a normally horizontal position. In the embodiment shown in the drawings, such resilient member is a tension spring 17 connected between normally aligned upper and lower rods 18 and 19 secured to boom end 16 and standard 2, respectively. Upper rod 18 is fixed relative to the hoop-supporting boom, and lower rod 19 is fixed relative to the standard, so that sidewise swinging of the boom moves such rods out of alignment to bend and stretch spring 17. Consequently, such tension spring resists sideways swinging of the hoop as well as vertical swinging of the hoop. The tension of the spring is adjustable by an adjusting nut 20 threaded on the lower rod.

Vertical swinging of the hoop can be damped by a shock absorber 21 having an upper end pivotally secured to the hoop-supporting boom by a lug 22 and a lower end universally secured to the standard by a ball and socket joint 23.

Auxiliary adjustable resilient mechanism for resisting sideways deflection of the hoop may be connected to the central joint system as shown in FIGS. 3 and 4. A torsion rod 24, such as a length of rubber of square cross section, is secured to the lower end of upright pivot shaft 13 by a socket 25 receiving the upper end of such rod. The lower end portion of the torsion rod is slidably received in a lower socket 26 carried by an adjustment member 27 slidable inside the standard. The adjustment member has a handle 28 projecting through a vertical slot 29 in the standard so that the position of the adjustment member and its socket relative to the standard and the torsion rod can be varied. The adjustment member can be secured in any of several positions by a pin 30 extending through aligned apertures in the standard and the adjustment member. Sliding of member 27 upward relative to the standard and the torsion rod decreases the effective length of the torsion rod, that is the length between sockets 25 and 26, increasing the sideways biasing force exerted by the torsion rod. Conversely, sliding of member 27 downward increases the effective length of the torsion rod making it easier to swing hoop 4 about the axis of upright pivot shaft 13. Consequently, the sideways biasing force on the hoop support structure can be adjusted independently of the vertical biasing force. Each of such forces can be adjusted according to the experience and strength of a player.

By combining a basket ball practice device in accordance with the present invention with mechanism allowing adjustment of the vertical height of a hoop above a playing surface, a practice device for developing basketball skills is provided for all players regardless of height or ability. Because of the great interest in the dunk shot, use of the practice device is emjoyable and, consequently, players need little encouragement to use the device.

I claim:

1. In a basketball hoop support including means for normally supporting the hoop stationarily in horizontal position, the improvement comprising the supporting means including a support arm connected to and carrying the hoop and horizontal deflection means supporting said support arm for substantial sideways movement of said support arm and the hoop carried thereby by the application of a sideways force to the hoop such as the force which may be applied to the hoop by a player during execution of a dunk shot.

2. In the support defined in claim 1, the support arm projecting generally radially from the hoop and the horizontal deflection means including means for biasing the support arm to a normal horizontally centered position.

3. In the support defined in claim 2, the horizontal deflection means including means for adjusting the biasing force of the biasing means.

4. In the support defined in claim 2, the horizontal deflection means including means for mounting the support arm for swinging about an upright axis offset from the hoop.

5. In the support defined in claim 4, the horizontal deflection means including auxiliary resilient means for biasing the support arm to its normal position, said auxiliary resilient means including a torsion rod generally coaxial with the offset upright axis and connected to the mounting means.

6. In the support defined in claim 5, the horizontal deflection means including means for adjusting the effective length of the torsion rod.

7. In the support defined in claim 1, the supporting means including vertical deflection means for allowing downward deflection of the support arm and the hoop carried thereby by application of a downward force to the hoop.

8. In the support defined to claim 7, the support arm projecting generally radially from the hoop, and resilient means for biasing the support arm to a normally horizontal position.

9. In the support defined in claim 8, means for adjusting the biasing force of the resilient means.

10. In the support defined in claim 7, the supporting means including an upright standard, and the support arm being a normally horizontal boom carrying the hoop at one end thereof, said boom being connected to the standard by the horizontal and vertical deflection means.

11. In the support defined in claim 10, the horizontal deflection means including a turntable having an upright pivot shaft generally coaxial with the standard, and the vertical deflection means including a horizontal pivot shaft rotatably carried by the turntable and connected to the boom.

12. In the support defined in claim 1, the supporting means including an upright standard, the support arm being a normally horizontal boom carrying the hoop at one end thereof and, the horizontal deflection means including a turntable having an upright pivot shaft generally coaxial with the standard.

* * * * *

UNITED STATES PATENT AND TRADEMARK OFFICE

CERTIFICATE OF CORRECTION

PATENT NO. : 4,151,989

DATED : May 1, 1979

INVENTOR(S) : William A. Dittrich

It is certified that error appears in the above-identified patent and that said Letters Patent are hereby corrected as shown below:

Title page, [56] References Cited, cancel "Schaminger" and insert --Schabinger--; cancel "Humphery" and insert --Humphrey--.

Column 3, line 58, cancel "emjoyable" and insert --enjoyable--.

Column 4, line 37, cancel "to" and insert --in--; line 58, insert a comma after "thereof" and cancel the comma after "and".

Signed and Sealed this

*Twenty-fifth* Day of *September 1979*

[SEAL]

*Attest:*

*Attesting Officer*

LUTRELLE F. PARKER

*Acting Commissioner of Patents and Trademarks*